US011781381B2

(12) United States Patent
Wyatt et al.

(10) Patent No.: US 11,781,381 B2
(45) Date of Patent: Oct. 10, 2023

(54) DRILL BORE PROTECTION DEVICE AND METHOD

(71) Applicants: Robert Wyatt, Lubbock, TX (US); David R Wyatt, Lubbock, TX (US)

(72) Inventors: Robert Wyatt, Lubbock, TX (US); David R Wyatt, Lubbock, TX (US)

( * ) Notice: Subject to any disclaimer, the term of this patent is extended or adjusted under 35 U.S.C. 154(b) by 132 days.

(21) Appl. No.: 17/011,736

(22) Filed: Sep. 3, 2020

(65) Prior Publication Data

US 2021/0062587 A1 Mar. 4, 2021

Related U.S. Application Data

(60) Provisional application No. 62/876,747, filed on Sep. 5, 2019, provisional application No. 62/876,749, filed on Sep. 3, 2019.

(51) Int. Cl.
*E21B 10/26* (2006.01)
*E21B 43/10* (2006.01)

(52) U.S. Cl.
CPC ..... *E21B 10/26* (2013.01); *E21B 43/103* (2013.01)

(58) Field of Classification Search
CPC ..... E21B 7/20; E21B 7/28; E21B 43/08
See application file for complete search history.

(56) References Cited

U.S. PATENT DOCUMENTS

| | | | | |
|---|---|---|---|---|
| 2,927,775 | A * | 3/1960 | Hildebrandt | E21B 25/06 175/245 |
| 4,740,116 | A | 4/1988 | Wellach | |
| 5,889,217 | A * | 3/1999 | Rossabi | E02D 1/025 73/864.74 |
| 7,387,174 | B2 * | 6/2008 | Lurie | E21B 7/20 175/57 |
| 8,020,635 | B2 | 9/2011 | Radford | |
| 2002/0088649 | A1 | 7/2002 | Morris et al. | |
| 2005/0034897 | A1 * | 2/2005 | Youan | E21B 7/20 175/406 |
| 2011/0203849 | A1 | 8/2011 | Radford et al. | |
| 2014/0246236 | A1 | 9/2014 | Radford et al. | |

* cited by examiner

*Primary Examiner* — Cathleen R Hutchins
(74) *Attorney, Agent, or Firm* — Boudwin Intellectual Property; Daniel Boudwin

(57) ABSTRACT

A drill bore protection device and method for protecting a drill bore are provided. The drill bore protection device includes an elongated member. The elongated member is defined by a front end and a rear end. A first sleeve is placed on the elongated member next to the front end of the elongated member. Additionally, a second sleeve is placed on the elongated member next to the rear end of the elongated member. The first sleeve and the second sleeve each have an open end and a closed end. The closed ends of the first sleeve and the second sleeve face the front end of the elongated member, while the open ends of the first sleeve and the second sleeve face the rear end of the elongated member. The first sleeve defines a first interior cavity. A liner is disposed in the first interior cavity of the first sleeve.

8 Claims, 3 Drawing Sheets

DRILL BORE PROTECTION DEVICE AND METHOD

CROSS REFERENCE TO RELATED APPLICATIONS

This application claims the benefit of U.S. Provisional Application No. 62/876,749 filed on Sep. 3, 2019 and U.S. Provisional Application No. 62/876,747 filed on Sep. 5, 2019. The above identified patent application is herein incorporated by reference in its entirety to provide continuity of disclosure.

BACKGROUND OF THE INVENTION

The present invention relates to an improvement to the typical process of horizontal directional drilling. Specifically, the present invention provides an improved method for protecting a conduit that is being installed using a horizontal direction drilling process.

Directional drilling processes, such as horizontal directional drilling, are utilized to assist workers in creating underground bores that may house utility lines, such as network lines, electrical lines, or the like. By allowing workers to drill underground without having to significantly disrupt roadways, buildings and other structures, utility line installation is safer and more efficient.

Typically, horizontal directional drilling consists of three primary steps. The first step is drilling a pilot bore, during which a drill head, operated by a drill rig, is directed along a pathway that will eventually be utilized in utility line installation. The drill head is remotely directed from the entry site to the exit site of the planned pathway. A drill pipe is situated behind the drill head, such that drill fluid may be pumped to the pathway to assist in removing debris, lubricating the drill pipe, and cooling the drill bit.

The second step is to ream the pilot bore using a reamer. Typically, once the drill head arrives at the exit site of the pathway, a reamer is attached to the drill pipe. A reamer is a cutting mechanism designed to enlarge the pilot bore to a desired size in order to accommodate the intended pathway size. The reamer is attached to a tail string, so that it may be pulled back once it returns to the entry site of the pathway. Multiple reamers may be passed through the pathway, such that a desired diameter may be reached. Once the reaming is completed, a swab pass is conducted. Typically, a swab pass involves passing a reamer (roughly the size of the desired diameter) is passed through the pathway to clear out any remaining cuttings or debris.

Finally, a conduit is fed through the pathway to complete the installation process. The conduit may be of any suitable construction. For example, the conduit may be steel or plastic tubing. Typically, as the conduit is pulled through the pathway, the conduit may be vulnerable to damage from drill bore cuttings, drill bore collapses, or hydro-lock. Furthermore, the pathway itself may be susceptible to structural damage, especially in the presence of certain types of soils. Therefore, there is a defined need amongst the known methods of horizontal directional drilling for a device to provide additional protection to a conduit that is being installed.

SUMMARY OF THE INVENTION

In view of the foregoing disadvantages inherent in the known types of directional drilling components now present in the prior art, the present invention provides a drill bore protection device wherein the same can be utilized for providing convenience for the user when installing an underground pathway for the installation of a desired conduit.

The present system comprises an elongated member. The elongated member defines a first end opposite a second end. A first sleeve is disposed on the elongated member proximally to the first end of the elongated member. A second sleeve is disposed on the elongated member proximally to the second end of the elongated member. The first sleeve and the second sleeve define a closed end opposite an open end. The closed ends of each of the first sleeve and the second sleeve face the front end of the elongated member. The open ends of each of the first sleeve and the second sleeve face the rear end of the elongated member. A liner is disposed in a first interior cavity defined by the first sleeve.

The present system further includes a method of using a drill bore protection device in a process for installing a conduit using horizontal directional drilling technology. The method for protecting a drill bore includes defining a pilot bore utilizing a pilot drill in operable connection with a drill rig. Once the pilot bore is defined, the pilot bore is then reamed, extending the circumference of the pilot bore to a desired circumference. The reamer is, like the pilot drill, operably connected to the drill rig. The drill bore protection device is utilized in combination with the conduit itself. The conduit is affixed to the drill bore protection device, such that when the drill bore protection device is pulled, the liner is disposed along the pilot bore to protect the conduit.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
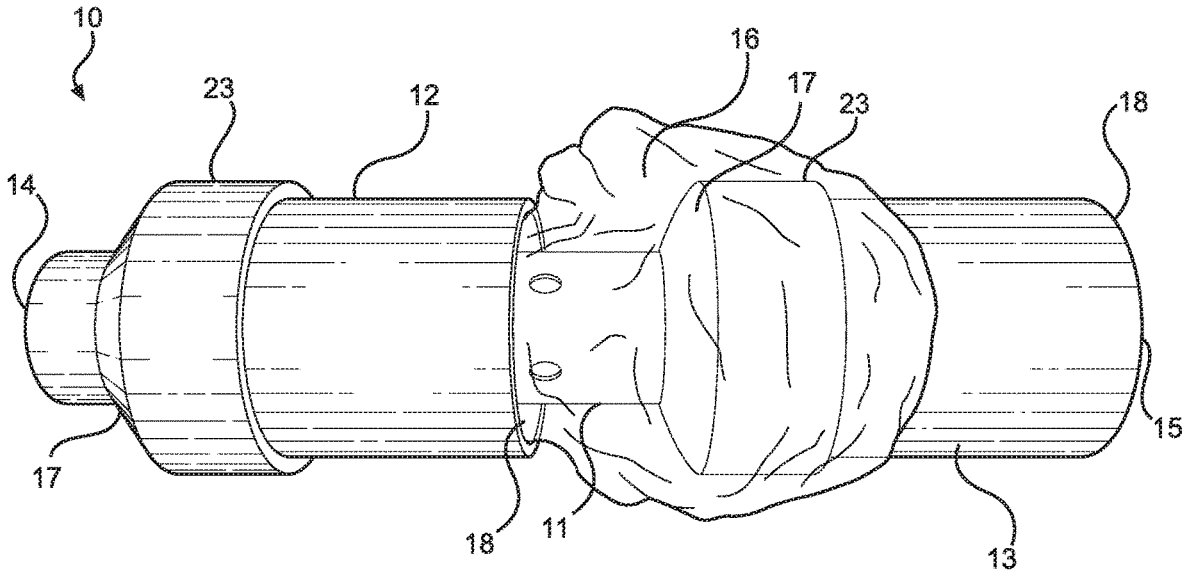
FIG. 1 shows a perspective view of an embodiment of the drill bore protection device.

Reference is made herein to the attached drawings. Like reference numerals are used throughout the drawings to depict like or similar elements of the drill bore protection device. The figures are intended for representative purposes only and should not be considered to be limiting in any respect.

Referring now to FIG. 1, there is shown a perspective view of an embodiment of the drill bore protection device. The drill bore protection device 10 comprises an elongated member 11. The elongated member 11 defines a front end 14 provided opposite of a rear end 15. In the illustrated embodiment, the elongated member 11 is linear in orientation, such as to provide components placed upon the elongated member 11 in a linear alignment. Additionally, in the demonstrated embodiment, the elongated member 11 is cylindrical in orientation. The elongated member 11 is made of any suitable material for use in horizontal directional drilling, such as a hard plastic like polyvinyl chloride or a metal like aluminum.

The elongated member 11 comprises a first sleeve 12. The first sleeve 12 is disposed on the elongated member 11 proximal to the front end 14 of the elongated member 11. The first sleeve 12 defines a closed end 17 and an open end 18. The closed end 17 of the first sleeve 12 faces the front end 14 of the elongated member 11. The open end 18 of the first sleeve 12 faces the rear end 15 of the elongated member 11. In the illustrated embodiment, a portion of the elongated member 11 extends beyond the closed end 17 of the first sleeve 12. The first sleeve 12 defines a first interior cavity (shown in FIG. 2). The first sleeve 12 is made of any suitable material for use in horizontal directional drilling, such as a hard plastic like polyvinyl chloride or a metal like aluminum.

Furthermore, the elongated member 11 comprises a second sleeve 13. The second sleeve 13 is disposed on the elongated member 11 proximal to the rear end 15 of the elongated member. The second sleeve 13 defines a closed end 17 and an open end 18. The closed end 17 of the second sleeve 13 faces the front end 14 of the elongated member 11. The open end 18 of the second sleeve 13 faces the rear end 15 of the elongated member 11. The second sleeve 13 defines a second interior cavity (shown in FIG. 2). The second sleeve 13 is made of any suitable material for use in horizontal directional drilling, such as a hard plastic like polyvinyl chloride or a metal like aluminum.

The drill bore protection device 10 further comprises a liner 16. The liner 16 is disposed in the first interior cavity of the first sleeve 12, between the first sleeve 12 and the second sleeve 13. The liner 16 is configured to extend as the drill bore protection device 10 is pulled through a pilot bore during horizontal directional drilling. As such, the liner 16 is affixed to the elongated member 11 within the first interior cavity of the first sleeve 12. The liner 16 is secured in the first interior cavity by any suitable means, such as by structural affixation or by use of an adhesive. The liner 16 is of any suitable material for protecting a conduit being installed underground. For example, the liner 16 may be made of a flexible, but durable plastic material. The liner 16 is tubular in construction such as to allow for a conduit to be entirely surrounded by the liner 16 as the conduit is being pulled through the passageway.

In the illustrated embodiment, each of the first sleeve 12 and the second sleeve 13 comprises a head 23. The head 23 is configured to form the closed ends 17 of each of the first sleeve 12 and the second sleeve 13. In the illustrated embodiments, the heads 23 are angled. The head 23 of the first sleeve 12 being angled enables the flow of drilling fluid or drill mud over the remaining portion of the drill bore protection device 10. The head 23 of the second sleeve 13 being angled enables the liner 16 to easily slide over the second sleeve 13 as the drill bore protection device 10 is pushed or pulled through a drill bore. As shown, the head 23 is of a greater diameter than the remaining portion of the first sleeve 12 and the second sleeve 13.

Figure 2:
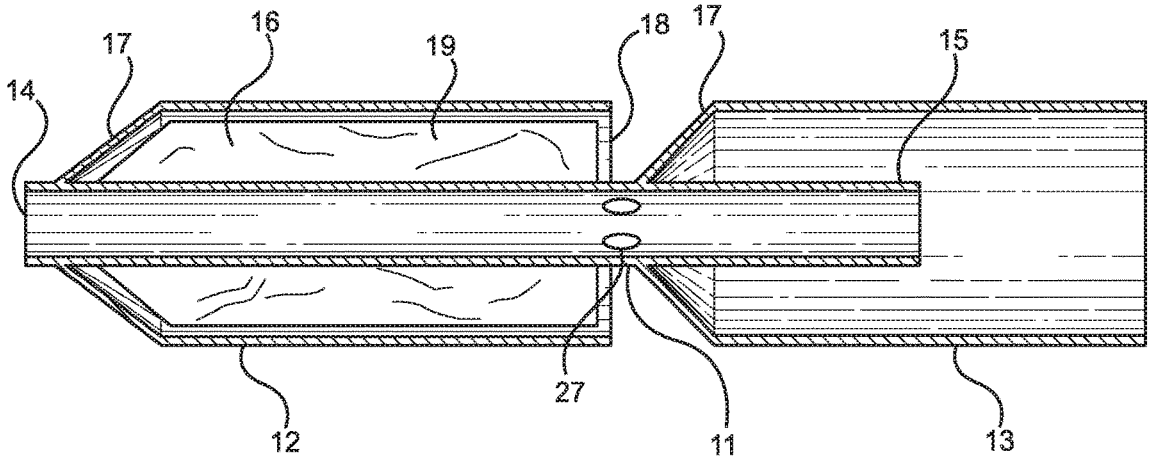
FIG. 2 shows a cross-sectional view of an embodiment of the drill bore protection device.

Referring now to FIG. 2, there is shown a cross-sectional view of an embodiment of the drill bore protection device. In the illustrated embodiment, the elongated member 11 is hollow in construction. Among other reasons, the hollow construction of the elongated member 11 allows for the passage of drilling fluid or drill mud through the elongated member 11 into the liner 16. In the illustrated embodiment, the elongated member 11 comprises a plurality of apertures 27. The plurality of apertures 27 are disposed on the elongated member 11 between the first sleeve 12 and the second sleeve 13. The plurality of apertures 27 will enable more efficient flow of drilling fluid or drilling mud through the drill bore protection device 10.

As shown, the liner 16 is disposed within the first interior volume 19 of the first sleeve 12. The liner 16 may be secured within the first interior volume 19 by any suitable means or mechanism. For example, the liner 16 may be stored in a rolling mechanism, such as to enable storage and transport of the drill bore protection device 10 within the liner 16 extending beyond the open end 18 of the first sleeve 12.

In the illustrated embodiment, the first sleeve 12 and the second sleeve 13 are of an identical diameter. In alternate embodiments, the first sleeve 12 and the second sleeve 13 are of different diameters. The second sleeve 13 must be of a suitable diameter, relative to the first sleeve 12 to enable the liner 16 to slide over the second sleeve 13 as the liner 16 is removed from the first interior cavity 19. In the illustrated embodiment, the closed end 17 of the second sleeve 13 is angled such as to assist the liner 16 in sliding over the second sleeve 13.

Figure 3:
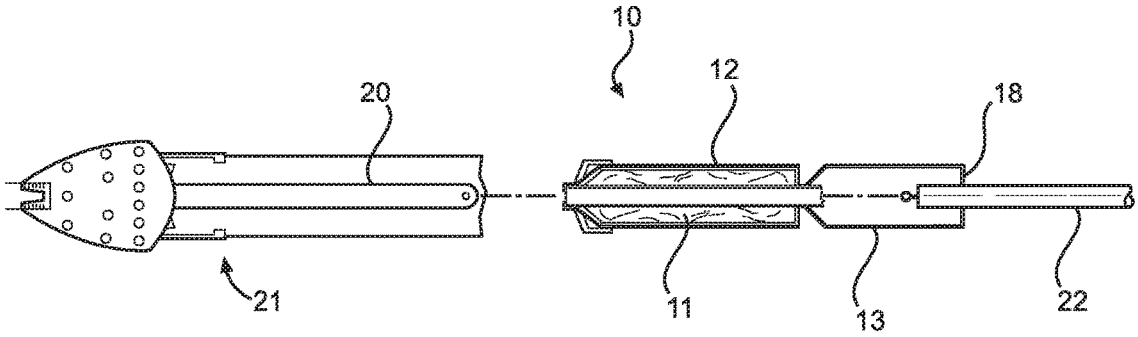
FIG. 3 shows a cross-sectional demonstrative view of an embodiment of the drill bore protection device.

Referring now to FIG. 3, there is shown a cross-sectional demonstrative view of an embodiment of the drill bore protection device. In the demonstrated embodiment, the elongated member 11 is configured to secure to a stinger 20 of a reamer 21. As such, the drill bore protection device 10 may be utilized as the reamer 21 is being utilized to ream a pilot bore. As the reamer 21 is pulled or pushed by a drill rig, the drill bore protection tool 10 can be affixed to the reamer 21 to protect a conduit 22 that is being pulled or pushed in operable connection with the reamer 21. Specifically, the conduit 22 is securable to the rear end of the elongated member 11 via the open end 18 of the second sleeve 13. The drill bore protection device 10 will protect the conduit 22 as well as ensuring that the conduit 22 is secured to the reamer 21.

Figure 4:
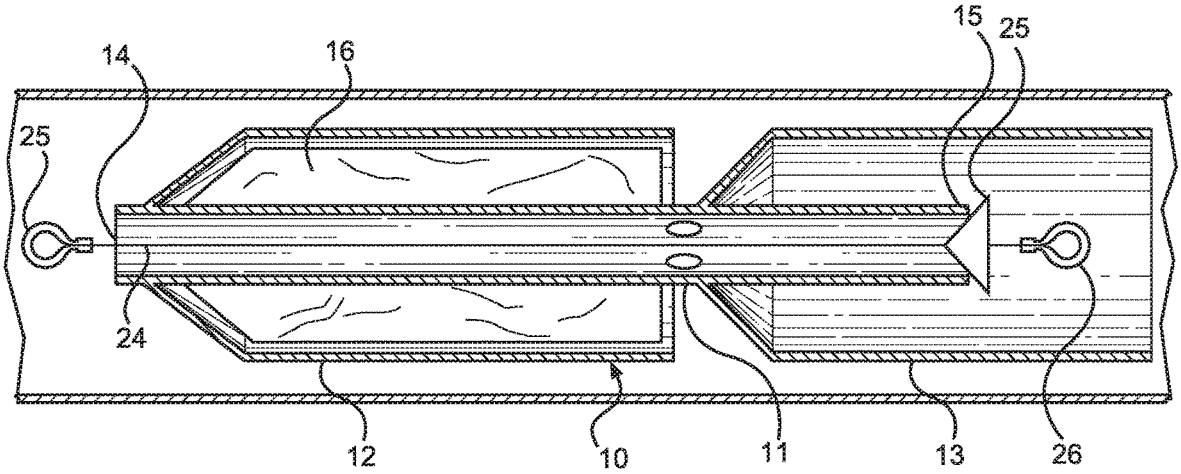
FIG. 4 shows a cross-sectional demonstrative view of an embodiment of the drill bore protection device.

Referring now to FIG. 4, there is shown a cross-sectional demonstrative view of an embodiment of the drill bore protection device. In the illustrated embodiment, the drill bore protection device 10 comprises a pull cable 24. The pull cable 24 is disposed through the elongated member 11 such that the pull cable 24 may be utilized to move the drill bore protection device 10 through a pilot bore. In the illustrated embodiment, the pull cable 24 comprises a stopper 25. The stopper 25 is configured to secure to the rear end 15 of the elongated member. As such, force applied to the pull cable 24 will be applied to the elongated member 11 via the stopper 25. The stopper 25 is of a greater diameter than the elongated member 11. Furthermore, in the demonstrated embodiment, the pull cable 24 comprises a front ring 25 and a rear ring 26 such as to enable bidirectional movement of the drill bore protection device 10 when utilized with a pull cable 24.

Figure 5:
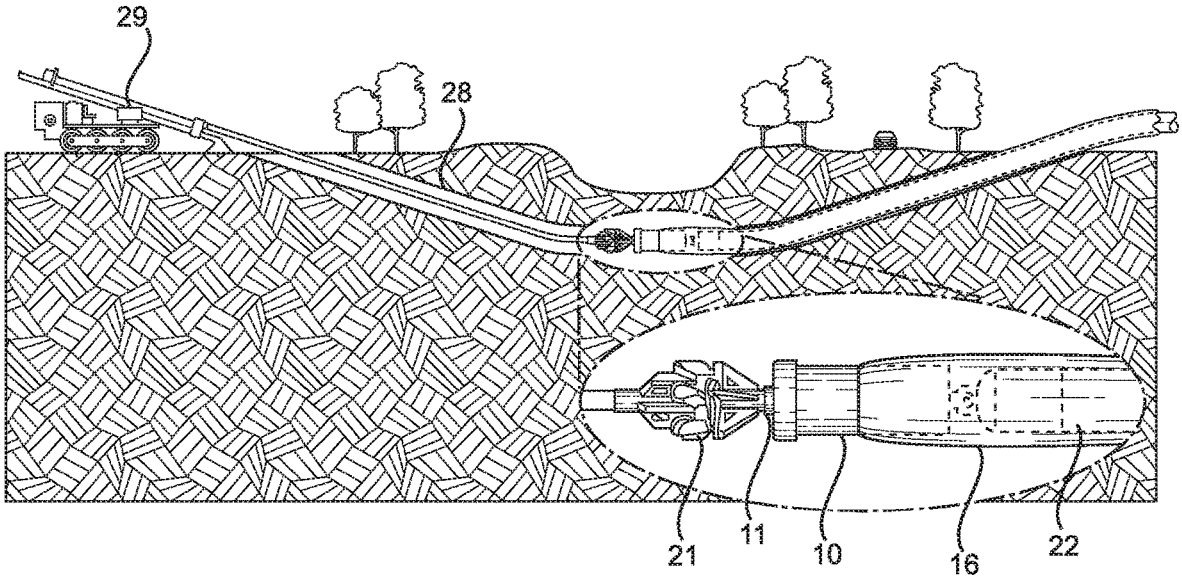
FIG. 5 shows a demonstrative view of an embodiment of the drill bore protection device.

Referring now to FIG. 5, there is shown a demonstrative view of an embodiment of the drill bore protection device. In use, the drill bore protection device 10 will assist individuals during the horizontal directional drilling process. A pilot bore 28 is first defined utilizing a pilot drill in operable connection with a drill rig 29. Once the pilot bore 28 is defined, the circumference of the pilot bore is increased to a desired size using a reamer 21. In the illustrated embodiment, the elongated member 11 of the drill bore protection device 10 is installed on the stinger of the reamer 21, such that as the reamer 21 is pulled through the pilot bore 28, the drill bore protection device 10 is also pulled through the pilot bore 28. Alternatively, the drill bore protection device 10 may be pulled through the pilot bore 28 by itself, using a pull cable (as shown and described in FIG. 4). As the drill bore protection device 10 is pulled through the pilot bore, with or without the reamer 21, the liner 16 will unravel, protecting the conduit 22 as it is being installed in the bore.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drill bore protection device, comprising:

an elongated member defining a front end opposite of a rear end;

a first sleeve defined on the front end of the elongated member;

the first sleeve defining a first interior cavity;

a second sleeve defined on the rear end of the elongated member;

the first sleeve and the second sleeve each defining a closed end and an open end;

the closed end of each of the first sleeve and the second sleeve facing the front end of the elongated member;

the open end of each of the first sleeve and the second sleeve facing the rear end of the elongated member;

a liner disposed in the first interior cavity of the first sleeve;

wherein the liner is affixed to the elongated member only within the first interior cavity of the first sleeve;

wherein the liner is stored in a rolling mechanism to enable storage and transport of the drill bore protection device within the liner extending beyond the open end of the first sleeve;

wherein the elongated member, the first sleeve and the second sleeve are made of a plastic material; and wherein the first sleeve and the second sleeve are identical in diameter.

2. The drill bore protection device of claim 1, wherein the elongated member is hollow in construction.

3. The drill bore protection device of claim 1, wherein the elongated member configured to secure to a stinger of a reamer.

4. The drill bore protection device of claim 1, wherein the rear end of the elongated member is configured to secure to a conduit.

5. The drill bore protection device of claim 1, wherein the first sleeve and the second sleeve comprise a head, wherein the head is of a greater diameter than a remainder portion of each of the first sleeve and the second sleeve.

6. The drill bore protection device of claim 1, wherein a pull cable comprising a stopper is disposed through the elongated member.

7. The drill bore protection device of claim 1, wherein a plurality of apertures are disposed on the elongated member between the first sleeve and the second sleeve.

8. The drill bore protection device of claim 1, wherein the liner is made of a lightweight and durable material.

* * * * *